United States Patent [19]

Murray

[11] 4,028,829

[45] June 14, 1977

[54] WARNING DEVICE FOR VEHICLES

[76] Inventor: Michael F. Murray, 189 Cedar Ave., Oroville, Calif. 95965

[22] Filed: May 5, 1975

[21] Appl. No.: 574,322

[52] U.S. Cl. ..... 40/129 C; 116/35 R

[51] Int. Cl.[2] ..... G09F 7/00

[58] Field of Search ..... 40/129 C, 51, 125 R, 40/37, 37.1; 116/35, 37, 42, 44

[56] References Cited

UNITED STATES PATENTS

| | | | |
|---|---|---|---|
| 1,863,688 | 6/1932 | Delmas | 116/42 |
| 2,753,830 | 7/1956 | Pillsbury et al. | 40/51 X |
| 3,418,962 | 12/1968 | Seward | 116/42 X |
| 3,479,982 | 11/1969 | Honcharenko | 116/35 R |
| 3,513,800 | 5/1970 | Radgens | 116/37 |

FOREIGN PATENTS OR APPLICATIONS

| | | | |
|---|---|---|---|
| 37,342 | 10/1930 | France | 116/37 |

*Primary Examiner*—Louis G. Mancene
*Assistant Examiner*—John H. Wolff
*Attorney, Agent, or Firm*—Clarence A. O'Brien; Harvey B. Jacobson

[57] ABSTRACT

An inertia actuated warning signal device for vehicles has an inertia member supported for limited reciprocating movement in a path extending along a direction of motion of an associated accelerating and decelerating vehicle, and for rotating movement about the path of reciprocating movement simultaneously with movement along the latter mentioned path.

8 Claims, 3 Drawing Figures

WARNING DEVICE FOR VEHICLES

BACKGROUND OF THE INVENTION

1. Field of the Invention

This invention relates generally to a warning device for vehicles, and particularly to an inertia actuated device for providing a visual warning of deceleration of a motor vehicle, and the like.

2. Description of the Prior Art

It is known generally to employ inertia-actuated devices in order to expose a warning sign in order to advise motorists, and the like, that the vehicle ahead of them is undergoing a deceleration. These warning display devices generally are designed to bring a sign bearing the word "Stop" and the like into viewing position under inertia forces generated by deceleration of an associated vehicle, and to remove the sign from viewing position under inertia forces generated by re-acceleration of the vehicle. Examples of such devices may be found in U.S. Pat. Nos. 1,875,676, issued Sept. 6, 1972 to H. J. Taplin, 3,418,962, issued Dec. 31, 1968 to H. H. Seward, 3,479,982, issued Nov. 25, 1969 to P. Honcharenko, and 3,713,800, issued May 26, 1970 to T. H. Radgens. Most of these known warning display devices, however, have rather complex construction employing sophisticated linkages and/or mirrors in order to properly display and remove the warning sign.

SUMMARY OF THE INVENTION

It is an object of the present invention to provide a warning device for motor vehicles, and the like, which is simple yet rugged of construction and reliable of operation.

It is another object of the present invention to provide an inertia-actuated warning device for motor vehicles which does not constitute a potential safety hazard in a vehicle.

It is still another object of the present invention to provide a warning device for motor vehicles which may be seen by other drivers at night and other periods of greatly reduced visibility.

These and other objects are achieved by providing an inertia-actuated warning signal device for vehicles which has: an inertia member; and supports arranged on a vehicle for mounting the inertia member for limited reciprocating movement in a path extending along a direction of motion of the vehicle during deceleration and acceleration of the vehicle, and for rotating movement about the path of movement simultaneously with movement along the path of movement.

According to a preferred embodiment of the present invention, the inertia member is a longitudinally extending planar member having longitudinally spaced ends and trunnions extending coaxially in opposite directions from the spaced ends of the planar member. The supports include a pair of spaced, substantially parallel, upstanding plates, each of which plates is provided with a longitudinal slot arranged substantially parallel to the other of the slots and extending generally parallel to the axis of movement of the associated vehicle. The trunnions are disposed in the longitudinal slots for limited reciprocating movement therein. Further, as will be appreciated, the trunnions will permit rotation of the inertia member within the slots.

The warning device according to the present invention advantageously further includes at least one stop member mounted on the inertia member for limiting rotation of the inertia member. This stop member can be in the form of a substantially rectangular plate having a diagonally rounded corner and a pair of diagonally opposed square corners. The plate is attached to the planar member at one of the longitudinally spaced ends thereof and is arranged generally perpendicular to the longitudinal extent of the planar member for permitting the square corners to cooperate with an associated support surface and limit rotation of the inertia member when the trunnions of same are in extreme positions in the slots provided in the plates. Further, the rounded corner facilitates rotation of the inertia member.

The supports may further include a pair of flanges, each of the flanges affixed to a respective one of the plates and arranged perpendicular thereto. By providing the flanges with a suitable adhering material, such as a conventional adhesive, the flanges, and therefore the plates, may be secured to the support surface of the vehicle associated with the warning device.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
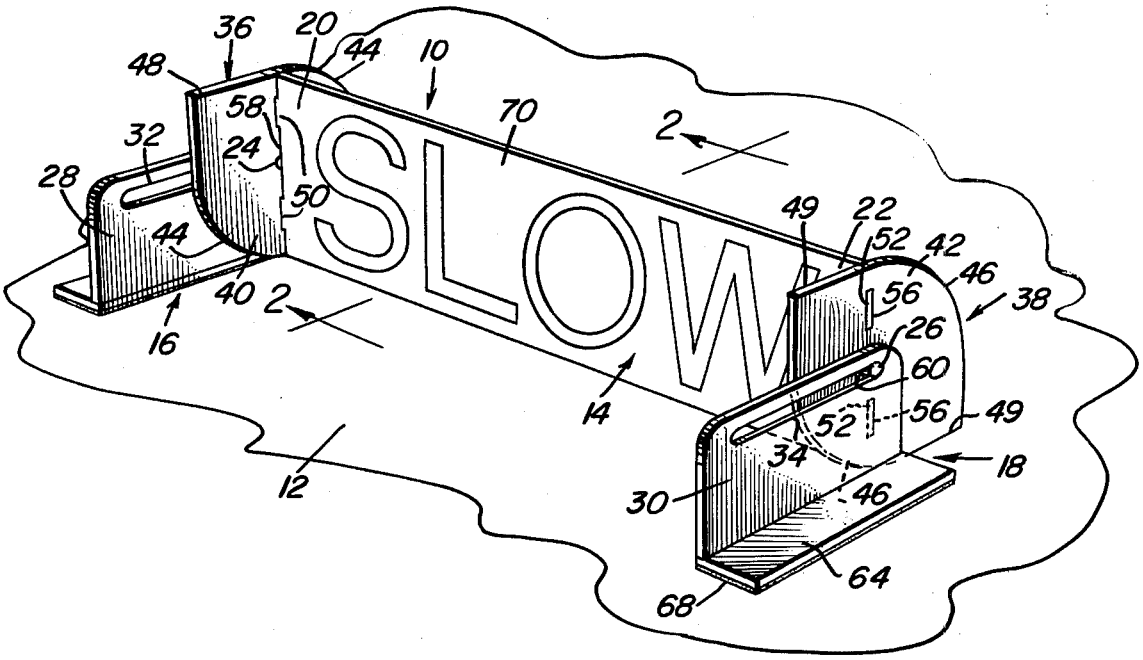
FIG. 1 is a perspective view showing an inertia-actuated warning signal device according to the present invention.

Referring now more particularly to the three figures of the drawing, an inertia-actuated warning signal device 10 according to the present invention is shown mounted on a support surface 12 which may be, for example, the rear deck of the passenger compartment of a conventional automobile or similar motor vehicle. Device 10 is illustrated as including an inertia member 14 supported by a pair of similar supports 16 and 18 which mount inertia member 14 for limited reciprocating movement in a path extending along a direction of motion of the vehicle associated with support surface 12 during deceleration and acceleration of the vehicle, and for rotating movement about the path of movement simultaneously with movement along the aforementioned path. The direction arrow in FIG. 1 indicates the normal, or forward, direction of movement of the vehicle that will properly actuate device 10 as arranged in FIG. 1.

Inertia member 14 is advantageously in the form of the illustrated longitudinally extending planar member having longitudinally spaced ends 20 and 22 and provided with trunnions 24 and 26 extending coaxially in opposite directions from ends 20 and 22. Supports 16 and 18 include a pair of spaced, substantially parallel, upstanding plates 28 and 30, each of the plates 28, 30 provided with a longitudinal slot 32, 34, respectively, arranged substantially parallel to the other of the slots 34, 32 and extending parallel to the axis of movement of the vehicle. Trunnions 24, 26 are disposed in the slots as can be readily seen from the drawings.

Stops 36 and 38 are advantageously mounted on inertia member 14 at ends 20 and 22 thereof for limiting rotation of member 14. These stops 36, 38 each comprises a substantially rectangular plate 40, 42 having a pair of diagonally rounded corners 44, 46, for example, and a pair of diagonally opposed square corners 48 and 49.

Figure 2:
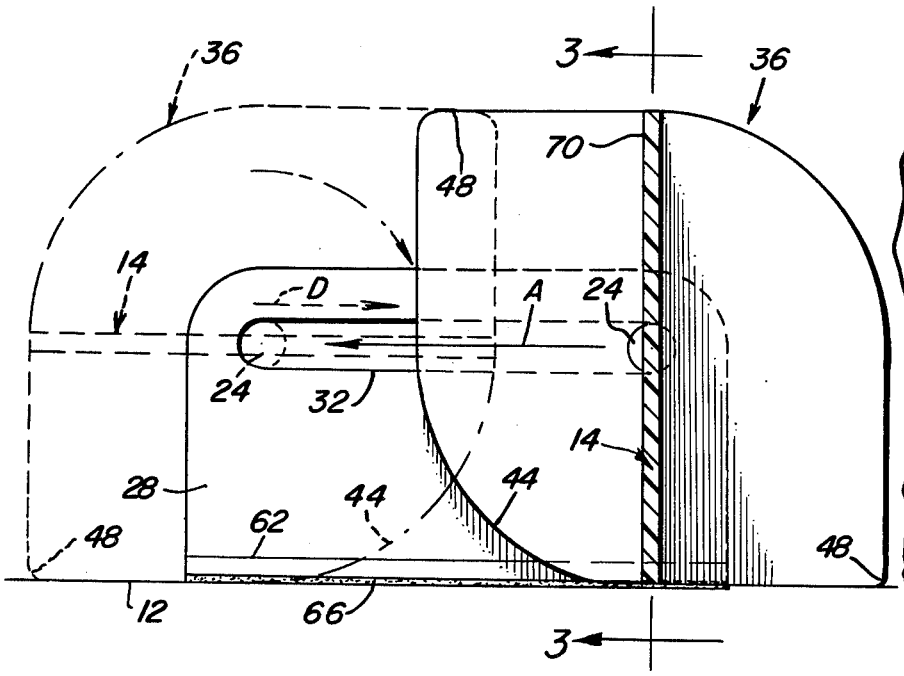
FIG. 2 is a sectional view taken generally along the line 2—2 of FIG. 1.
Figure 3:
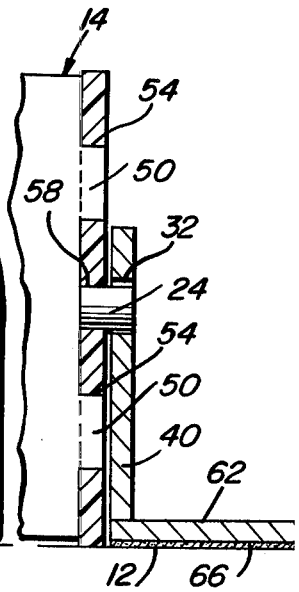
FIG. 3 is a fragmentary, sectional view taken generally along the line 3—3 of FIG. 2.

Plate 40 is illustrated as attached to member 14 at end 20 thereof, while plate 42 is illustrated as attached to end 22 of member 14. The plates 40, 42 are arranged parallel to one another and substantially perpendicular to the longitudinal extent of the planar member 14 for permitting the square corners 48, 49 to cooperate with support surface 12 and limit rotation of inertia member 14 when trunnions 24, 26 are in extreme positions in the slots 32, 34 of the plates 40, 42, with rounded corners 44, 46 facilitating rotation of inertia member 14. As can best be seen from FIG. 2 of the drawings, only one rounded corner 44, 46 is necessary for each plate 40, 42 as the other corner never contacts support surface 12.

Planar member 14 is provided with tabs 50, 52 at each of the spaced ends 20, 22, respectively, thereof, and each plate 40, 42 of the stops 36, 38 is provided with a pair of slits 54 and 56, respectively, arranged mating with tabs 50, 52 for receiving the tabs 50, 52 so as to mount the associated plate 40, 42 on inertia member 14. Further, plates 40, 42 are provided with apertures 58, 60, respectively, arranged for receiving an associated one of the trunnions 24, 26. In this manner, stops 36, 38 are mounted on inertia member 14 in a simple, yet rugged and reliable manner.

Supports 16 and 18 include in addition to the panels or plates 28, 30 a respective flange 62, 64. Each of the flanges 62, 64 is affixed to a respective one of the panels or plates 28, 30, and is arranged perpendicular thereto, with the flanges 62, 64 being provided with a layer of a suitable adhesive 66, 68, respectively, for securing the panels or plates 28, 30 to support surface 12 as desired.

Device 10 is advantageously constructed entirely of a, for example, latex material. Further, as can be appreciated from the above description, the only moving part is the rocker-type sign reading, for example, "Slow" or other suitable slogan pertaining to safety signs. The background of the "Slow"sign, when visible to a motorist following the vehicle associated with support surface 12, is advantageously formed by a layer of light-reflective material, such as that shown under the trademark "Scotchlite", for night visibility by having the letters of the warning word cut out of the layer of light-reflective material.

As mentioned above, device 10 is advantageously constructed from a rubber-like material, such as semi-rigid polyvinyl chloride, and the like. Further, the trunnions 24, 26 may be constructed from suitably-sized dowels constructed from the same material as the remainder of the inertia member 14, or from a similar material. The inertia member 14 may be constructed as by molding with the trunnions 24, 26 made integral therewith, or the trunnions 24, 26 could be made separately and bonded, and the like, in a conventional manner to a piece of sheet material employed to construct member 14.

As will be appreciated from the above description and from the drawings, device 10 functions to warn a motorist (not shown) following a car which is slowing down or stopping for some reason or another. On bright, sunny days, and the like, it is not easy for many motorists to see the stop-lights on the car in front of them. Further, vehicles frequently decelerate without braking. Accordingly, device 10, when activated, will alert the following driver, as his line of vision is in line with the sign on inertia member 14, of deceleration of the vehicle which he is following. While the light-reflective surface of the sign portion of inertia member 14 permits reading of the sign at night, during daylight the reflective surface appears as a, for example, plain white background, or other color as desired.

Device 10 is activated the instant the driver of the vehicle associated with support surface 12 touches his brake pedal, or even merely slows down by releasing his accelerator pedal. Due to the inertia of member 14, the latter will be pulled forward relative to the decelerating vehicle. As member 14 slides forwardly in slots 32, 34, as indicated by the broken-line arrow designated D in FIG. 2 of the drawing, the planar member 14 will move from the horizontal broken-line position shown in FIG. 2 to the vertical, full line position also shown in FIG. 2 of the drawing. Thus, member 14 makes a half-turn as it moves along slots 32, 34, and the warning signs provided on member 14 as by the light-reflective material 70 will be revealed to the driver behind the car associated with device 10. The same action is duplicated in reverse the moment the driver of the car associated with support surface 12 touches his or her accelerator pedal. Since the inertia of member 14 will tend to remain the same as the vehicle accelerates, member 14 will have a tendency to move backwards relative to the vehicle. This tendency will cause member 14 to re-assume the broken-line position shown in FIG. 2 of the drawings, and accordingly cancel out the warning sign formed by material 70. Further, member 14 will remain in the illustrated broken-line horizontal position, with the warning sign out of sight, until the next deceleration of the associated vehicle. As can be readily appreciated from FIG. 2, the square corners 48, 49 of the stops 36, 38 assure that inertia member 14 remains in either the illustrated horizontal or vertical positions. Further, while the pair of illustrated stops 36, 38 are desirable, it will be appreciated that only one such stop 36, 38 is necessary to function of the warning device according to the invention.

The foregoing is considered as illustrative only of the principles of the invention. Further, since numerous modifications and changes will readily occur to those skilled in the art, it is not desired to limit the invention to the exact construction and operation shown and described, and accordingly all suitable modififations and equivalents may be resorted to, falling within the scope of the invention.

What is claimed as new is as follows:

1. An inertia-actuated warning signal device for vehicles, comprising, in combination:

a. an inertia member; and b. support means arranged on a vehicle for mounting the inertia member for limited reciprocating movement in a path extending along a direction of motion of the vehicle during deceleration and acceleration of the vehicle, and for rotating movement about the path of movement simultaneously with movement along the path of movement, and the inertia member is a longitudinally extending planar member having longitudinally spaced ends, and trunnions extending coaxially in opposite directions from the spaced ends, and the support means includes a pair of spaced, substantially parallel, upstanding panels, each of the panels provided with a longitudinal support slot arranged substantially parallel to each other and extending parallel to the direction of movement of the vehicle, the trunnions being disposed in the slots for sliding movement therein.

2. A structure as defined in claim 1, further including stop means mounted on the inertia member for limiting rotation of the inertia member.

3. A structure as defined in claim 2, wherein the stop means includes a pair of substantially rectangular plates, each plate having a rounded corner and a pair of diagonally opposed square corners, one of the plates being attached to the planar member at one of the longitudinally spaced ends thereof and the other of the plates attached to the other of the longitudinally spaced ends of the planar member forming the inertia member, the plates being arranged parallel to one another and perpendicular to the longitudinal extent of the planar member for permitting the square corners to cooperate with a support surface and limit rotation of the inertia member when the trunnions of same are in extreme positions in the slots of the panels, and the rounded corner facilitating rotation of the inertia member as same moves in the slots of the panels.

4. A structure as defined in claim 3, wherein the planar member is provided with a tab at each of the spaced ends thereof, and each plate of the stop means is provided with a slit arranged for receiving an associated tab and an aperture arranged for receiving an associated one of the trunnions.

5. A structure as defined in claim 4, wherein the support means further includes a pair of flanges, each of the flanges affixed to a respective one of the plates and arranged perpendicular thereto, the flanges provided with adhering means for securing the plates to a support surface, and wherein said warning means includes a light-reflective material arranged over one planar surface of the planar member forming the inertia member, such surface being arranged for being viewed from behind the vehicle on which the warning device is arranged whenever the inertia member is in a vertical orientation, with letters being cut out of the light-reflective material to form a warning word to the driver of a following vehicle.

6. An inertia-actuated warning signal device for vehicles, comprising, in combination:

a. an inertia member; and b. support means arranged on a vehicle for mounting the inertia member for limited reciprocating movement in a path extending along a direction of motion of the vehicle during deceleration and acceleration of the vehicle, and for rotating movement about the path of movement simultaneously with movement along the path of movement, further including stop means mounted on the inertia member for limiting rotation of the inertia member, and the stop means including a substantially rectangular plate having a rounded corner and a pair of diagonally opposed square corners, the plate being arranged substantially perpendicular to the longitudinal extent of the planar member for permitting the square corners to cooperate with a support surface associated with the support means and limiting rotation of the inertia member when same is in the extreme positions of the limited reciprocating movement, and the rounded corner facilitating rotation of the inertia member about the path of movement simultaneously with the limited reciprocating movement along the path.

7. An inertia-actuated warning signal device for vehicles, comprising, in combination:

a. an inertia member; and b. support means arranged on a vehicle for mounting the inertia member for limited reciprocating movement in a path extending along a direction of motion of the vehicle during deceleration and acceleration of the vehicle, and for rotating movement about the path of movement simultaneously with movement along the path of movement, further including stop means mounted on the inertia member for limiting rotation of the inertia member, and the support means including adhering means for securing the warning device to a support surface of an associated vehicle, and wherein the inertia member is a planar member and a light-reflective material being provided on a planar surface of the planar member, with letters being cut out of the light-reflective material for forming a warning sign on the inertia member.

8. A structure as defined in claim 7, wherein the stop means includes a substantially rectangular plate having a rounded corner and a pair of diagonally opposed square corners, the plate beig arranged substantially perpendicular to the longitudinal extent of the planar member for permitting the square corners to cooperate with a support surface associated with the support means and limiting rotation of the inertia member when same is in the extreme positions of the limited reciprocating movement, and the rounded corner facilitating rotation of the inertia member about the path of movement simultaneously with the limited reciprocating movement along the path.

* * * * *